United States Patent [19]

Engeling et al.

[11] 4,044,950

[45] Aug. 30, 1977

[54] COMBINED HEAT-EXCHANGER AND SUPPLEMENTAL AIR CIRCULATOR FOR HOT-AIR FURNACES

[76] Inventors: Charles F. Engeling, R.R. No. 1, Morrisonville, Ill. 62546; Ralph F. Staubly, 510 Myers Bldg., Springfield, Ill. 62701

[21] Appl. No.: 611,357

[22] Filed: Sept. 8, 1975

[51] Int. Cl.[2] ..... F24B 7/02

[52] U.S. Cl. ..... 237/55; 126/116 A; 126/110 R; 165/DIG. 2; 165/76; 165/137

[58] Field of Search ..... 165/DIG. 2, 76, 137; 237/55; 126/110 R, 99 R, 113, 116 A, 117, 110 E

[56] References Cited

U.S. PATENT DOCUMENTS

| | | | |
|---|---|---|---|
| 1,487,709 | 3/1924 | Besser | 165/DIG. 2 |
| 1,558,848 | 10/1925 | Doble, Jr. | 126/116 A |
| 1,953,302 | 4/1934 | Johnston | 126/117 |
| 2,272,356 | 2/1942 | Sims | 237/55 |
| 2,289,206 | 7/1942 | Nessell | 126/110 R |
| 2,362,940 | 11/1944 | Skerritt | 165/39 |
| 2,439,109 | 4/1948 | Stout | 126/117 |
| 2,962,218 | 11/1960 | Dibert | 237/55 |
| 3,472,496 | 10/1969 | Coleman et al. | 126/113 |
| 3,739,767 | 6/1973 | Peters | 126/113 |
| 3,944,136 | 3/1976 | Huie | 237/55 |

*Primary Examiner*—John J. Camby
*Assistant Examiner*—Henry C. Yuen
*Attorney, Agent, or Firm*—Ralph F. Staubly

[57] ABSTRACT

A fuel-burning forced-air-circulating heating system having a thermostatically controlled heavy-duty blower, and a constantly operable relatively low-powered supplemental air-circulating attachment for forcing air from the cold-air-return plenum to the hot-air-feed plenum of a conventional hot-air furnace. The supplemental attachment bypasses the furnace so that the air-flow resistance of the air filter of the furnace minimizes reverse air-flow through the furnace, resulting in a gentle temperature-equalizing circulation of air through the rooms being heated. Preferably, and very importantly, the supplemental attachment may include a heat-exchanger associated with the furnace flue to further improve the thermal efficiency of the system thus modified.

4 Claims, 4 Drawing Figures

COMBINED HEAT-EXCHANGER AND SUPPLEMENTAL AIR CIRCULATOR FOR HOT-AIR FURNACES

BACKGROUND OF THE INVENTION

A few prior-art hot-art furnaces have employed two built-in blowers to vary the volume of air circulated for low and high heating phases, e.g. Kriechbaum U.S. Pat. No. 2,109,862 and Rifle U.S. Pat. No. 2,672,291. But in such furnaces usually both blowers are high-powered, are not designed for attachment to existing furnaces, and lack low-volume flow through a flue-associated heat-exchanger.

SUMMARY AND OBJECTS OF THE INVENTION

The principal object of the invention is to provide an attachment for an installed conventional hot-air furnace, which attachment has a fuel-saving flue-engaging heat-exchanger as part of a supplemental low-powered constantly energized furnace-bypassing conduit system for reducing temperature gradients in the spaces being heated. Other objects and advantages will become apparent as the following description proceeds.

SHORT DESCRIPTION OF THE DRAWINGS

DETAILED DESCRIPTION

Figure 1:
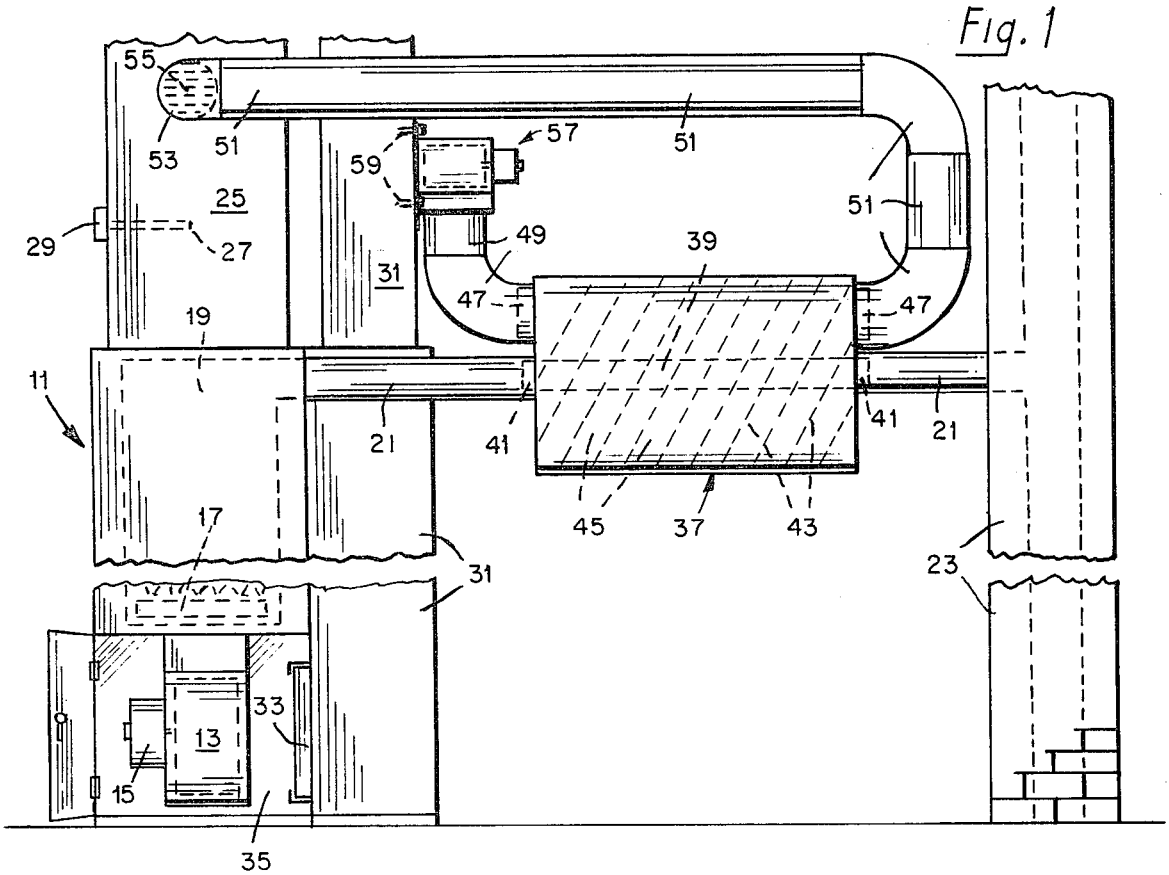
FIG. 1 is a front elevational view of a preferred embodiment.
Figure 2:
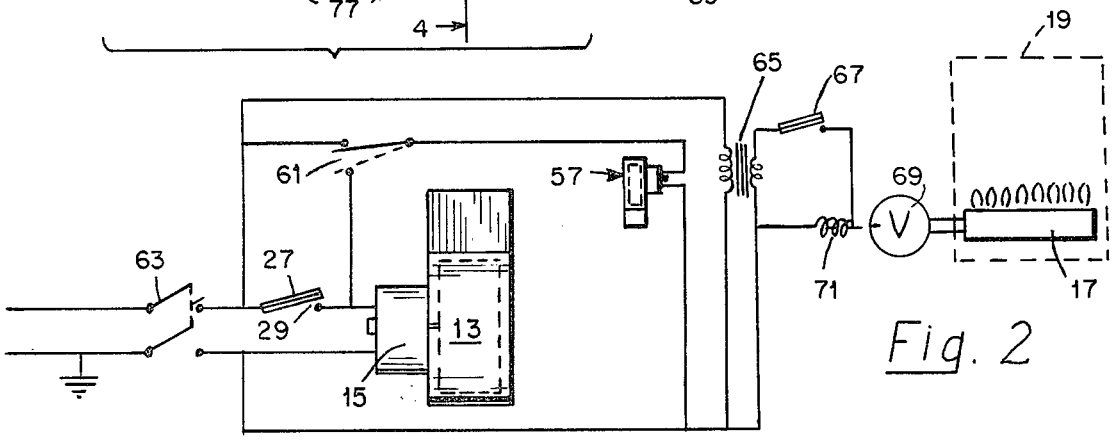
FIG. 2 is a schematic wiring diagram.

With reference now to FIGS. 1 and 2 of the drawings, the numeral 11 generally designates a conventional hot-air furnace having a blower 13 energized by a motor 15, a fuel burner 17 in a combustion chamber 19, and a flue pipe 21 discharging into a chimney 23. Furnace 11 further has a hot-air plenum 25 into which extends the thermostat 27 of a blower-controlling switch 29, and a cold-air-return plenum 31 which discharges through a filter 33 into a blower housing 35.

The attachment of the present invention comprises a heat-exchanger 37 having a centrally disposed pipe 39, the ends 41 of which connect with mating ends of the flue-pipe sections 21. The heat-exchanger 37 has baffles 43 defining a helical air passage 45 connected at its ends by sleeves 47 to air-input conduit section 49 and to air-output conduit section 51. The discharge end of the conduit section 51 is an elbow 53 fitted into an aperture cut in the plenum chamber 25. The inner end of the elbow 53 may be bridged by a plate having upwardly angled louvers 55 to deflect the air upwardly in the plenum 25.

Air is pulled from the upper portion of the return plenum 31 by a relatively low-powered motor-driven blower 57, mounted (as by self-tapping screws 59) over an opening cut in said plenum. The motorized blower is of the order of a fifth of the power of the furnace blower 13–15, and is connected into the furnace circuit by a double-throw switch 61. The switch 61 permits the blower 57 to be energized constantly when the master swtich 63 is closed, or to be energized only when the bonnet switch 27–29 is closed during a heating cycle.

The right third of FIG. 2 is the conventional circuitry of the original installation being modified, and comprises a step-down transformer 65, a room thermostatic switch 67, and a valve 69 controlling the supply of fuel to the burner 17. The valve 69 (or an equivalent stoker-feeder motor) is controlled by a solenoid 71 energized by parts 65 and 67.

Figure 3:
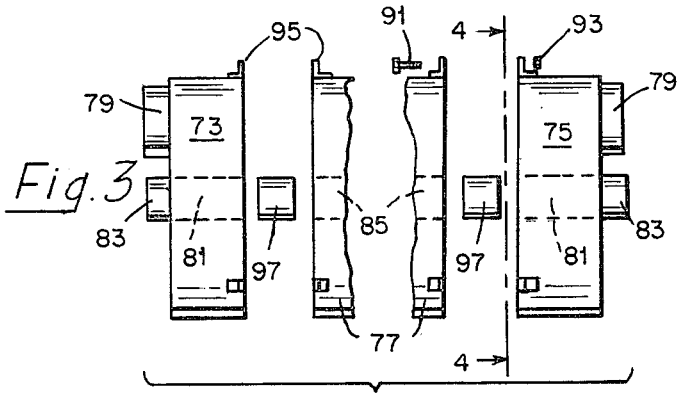
FIG. 3 is an exploded side view of a modified heat-exchanger.
Figure 4:
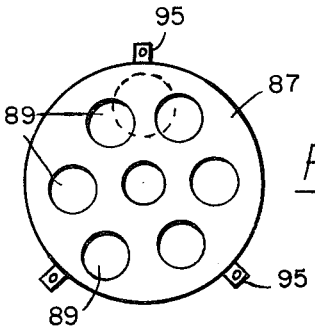
FIG. 4 is an end view taken on the line 4—4 of FIG. 3.

FIGS. 3 and 4 disclose a modified form of heat-exchanger, comprising a pair of end sections 73 and 75 and one or more intermediate sections 77. Each end section has inlet or outlet sleeves 79 for connection to the mating ends of auxiliary conduits 49 or 51 (FIG. 1), and axial tubes 81 for connection by their extending ends 83 to mating ends of flue sections 21. The intermediate exchange sections 77 have central flue pipes 85, and face plates 87. Plates 87 have apertures 89 which align with like apertures in the face plates of the other sections 73, 75 and 85, the alignment being produced by bolts 91 and nuts 93 passing through asymmetrically positioned apertured angle brackets 95, welded or otherwise fixed to the sections as shown. The tubes 81 and 85 are interconnected by sleeves 97.

While the operation of the hereby modified system of FIGS. 1 and 2 is readily understandable, it should be noted that for mild weather, of if an air-cooling heat-exchanger should be installed in the hot-air plenum, it may be desirable to throw switch 61 to its dashed-line position so that the auxilliary blower will operate only during a cooling cycle.

Having thus described our invention, we claim:

1. In a forced-circulation air-heating system comprising a conventional fuel-burning hot-air furnace including a hot-air-feed duct system and a cold-air-return duct system, a pipe for conducting flue gases away from said furnace, a first thermostatic switch in and responsive to the temperature of the space to be heated, furnace-connected fuel-supply means controlled by said first thermostatic switch, a relatively high-power motorized blower for forcing air from said return system through said furnace and to said feed system, an air filter in the air-flow path to and through and from said furnace, a second thermostatic switch located in the hot-air portion of said air-flow path for energizing said high-power motorized blower upon a selected rise in furnace air temperature, the improvement comprising: a normally constantly energized relatively low-power motorized blower, and duct means connecting said latter blower so as to force air from said return system into said feed system in bypassing relation to said furnace and its air filter, said duct means including in series therewith a heat-exchanger adapted for good thermal association with said flue-gas pipe, and said heat-exchanger including means for performing an indirect heat exchange between the cold by-pass air and the hot flue gases or combustion products, whereby, the lower-power blower being normally constantly energized during heating periods, a gentle temperature-stratification-reducing air-flow is produced.

2. Structure according to claim 1, said lower-power blower having a flange on its intake side for attachment over an opening formed in a wall of said return duct system, and the discharge end of said duct means being at least partially bridged by vanes for deflecting air upwardly in said hot-air-feed duct system.

3. Structure according to claim 1, said heat-exchanger being formed of a plurality of co-axially connectable sections, whereby its length may be easily varied for differend furnace installations.

4. Structure according to claim 1, and additionally comprising switch means for selectively connecting said low-power blower for either constant energization or energization only when said high-power blower is energized.

* * * * *